US005769275A

United States Patent [19]

Boehmer et al.

[11] Patent Number: 5,769,275

[45] Date of Patent: Jun. 23, 1998

[54] DUAL DISPENSING VALVE ASSEMBLY

[75] Inventors: Dennis A. Boehmer, Beavercreek; James C. Bailey, Yellow Springs; Gordon E. Atkinson, Cedarville; James R. Kunce, Springfield, all of Ohio

[73] Assignee: Vernay Laboratories, Inc., Yellow Springs, Ohio

[21] Appl. No.: 678,557

[22] Filed: Jul. 8, 1996

[51] Int. Cl.[6] ..... B67D 5/52

[52] U.S. Cl. ..... 222/136

[58] Field of Search ..... 222/136, 145.5, 222/144.5, 383.1, 482, 494; 137/512.4

[56] References Cited

U.S. PATENT DOCUMENTS

| | | | |
|---|---|---|---|
| 3,610,472 | 10/1971 | Bruno | 222/145 |
| 3,674,180 | 7/1972 | Morane | 222/145 |
| 3,704,814 | 12/1972 | Ruscitti | 222/145 |
| 3,760,986 | 9/1973 | Castner et al. | 222/137 |
| 4,020,977 | 5/1977 | Hechler, IV | 222/145 |
| 4,083,474 | 4/1978 | Waite et al. | 222/145 |
| 4,437,490 | 3/1984 | Demers et al. | 137/512.4 |
| 4,489,861 | 12/1984 | Saito et al. | 137/512.4 X |
| 5,021,219 | 6/1991 | Rudick et al. | 422/112 |
| 5,033,644 | 7/1991 | Tentler | 222/57 |
| 5,033,648 | 7/1991 | Nakayama et al. | 222/129.1 |
| 5,152,461 | 10/1992 | Proctor | 239/304 |
| 5,169,029 | 12/1992 | Behar et al. | 222/1 |
| 5,398,846 | 3/1995 | Corba et al. | 222/1 |
| 5,402,916 | 4/1995 | Nottingham et al. | 222/134 |
| 5,542,670 | 8/1996 | Morano | 137/512.4 X |

*Primary Examiner*—Gregory L. Huson
*Attorney, Agent, or Firm*—Biebel & French

[57] ABSTRACT

A dual valve assembly for use with a dispensing apparatus including a pump and a plurality of fluid containers. The valve assembly includes a housing containing an elastomeric regulator wherein the regulator includes a diaphragm portion for controlling fluid flow through the housing, and a vent valve structure for opening and closing air passages to supply air to the containers. The diaphragm portion includes an orifice, and the diaphragm portion is movable into and out of contact with a seat defined on the housing to control fluid flow from the containers and through the orifice during actuation of the pump. In addition, the vent valve structure includes a pair of vent membranes which open vent openings to the containers in response to negative pressure applied from the pump.

23 Claims, 6 Drawing Sheets

DUAL DISPENSING VALVE ASSEMBLY

BACKGROUND OF THE INVENTION

1. Field of the Invention

The present invention relates generally to the field of fluid dispensers, and more particularly, to a valve assembly for use in a fluid dispenser for dispensing two fluids in a controlled manner.

2. Description of Prior Art

Dual dispensing containers for spraying a mixture of two fluids are known. Such containers are particularly useful for dispensing two fluids having active ingredients which are incompatible, but which provide a desired result when mixed during a dispensing operation. For example, dual dispensing containers have been found useful for simultaneously dispensing two cleaning fluids which would have reduced efficacy if allowed to mix in solution.

In addition, it has been recognized that it is desirable to control the dispensing of fluids from dual dispensing containers such that the fluids in both containers will be depleted at substantially the same time. In order to obtain this result, factors relating to the supply of the fluids to the sprayer must be carefully controlled, including providing proper venting of the fluid containers to permit air to enter the containers and equalize pressure during dispensing of the fluids. The provision of appropriate venting to the containers has proven to be especially problematical in that the venting requires substantially free flow of air into the containers while also requiring that a valving mechanism be provided for preventing fluid from escaping out of the vent openings. In addition, the valving mechanism must be capable of opening instantaneously upon initiation of dispensing of the fluid in order to avoid unequal distribution of the two fluids.

A further requirement of the valve mechanism for controlling dispensing of the fluid is that upon termination of the dispensing operation, the fluids are prevented from flowing back into the containers in order to avoid mixing of the fluids. The valve for preventing back flow of fluid must also provide for substantially equal and unrestricted flow of fluids from the containers during a dispensing operation.

SUMMARY OF THE INVENTION

The present invention provides a dual dispensing valve assembly for providing controlled flow of fluids from two containers for dispensing from a single nozzle.

The valve assembly generally includes a housing containing an elastomeric regulator wherein the regulator includes a diaphragm portion for controlling fluid flow through the housing, and a vent valve structure for opening and closing air passages to supply air to fluid containers. More particularly, the housing includes a base portion and a cap portion which are engaged with each other and enclose the regulator. A plurality of fluid supply inlets are defined in the base portion for supplying fluid to the housing from fluid containers and an outlet is defined in the cap portion for conveying fluid from the housing.

The diaphragm includes an upper surface and a lower surface, and an orifice is defined through the diaphragm extending between the upper and surfaces and is in fluid communication with the outlet. Fluid passages are defined between the regulator and the base portion, and are located between the supply inlets and the orifice for suppling fluid to the orifice. A diaphragm seat is defined on the base portion for engagement with the diaphragm whereby a fluid seal is defined between the supply inlets and the orifice to thereby control fluid flow through the orifice to the outlet.

The vent valve structure includes a pair of membranes formed integrally with the regulator and positioned over vent openings formed in the base portion. The diaphragm is movable out of engagement with the diaphragm seat and the vent membranes are simultaneously movable to open the vent openings in response to a negative pressure applied through the outlet by a pump.

The vent membranes provide for positive opening of the vent openings while also providing a positive means for preventing leakage of fluids from the containers. Accordingly, the vent valve structure provides a balanced venting of a plurality of fluid containers wherein the opening of the vent structure corresponds to the initiation of a fluid dispensing operation.

Therefore it is an object of the present invention to provide a valve assembly for providing controlled mixing of plural fluids.

It is a further object of the invention to provide such a valve assembly including a venting structure which is actuated during dispensing of the fluid.

It is yet another object of the invention to provide such a valve assembly wherein the venting structure is positively actuated to assure that venting occurs when a dispensing operation is initiated.

Other objects and advantages of the invention will be apparent from the following description, the accompanying drawings and the appended claims.

DETAILED DESCRIPTION OF THE PREFERRED EMBODIMENT

Figure 1:
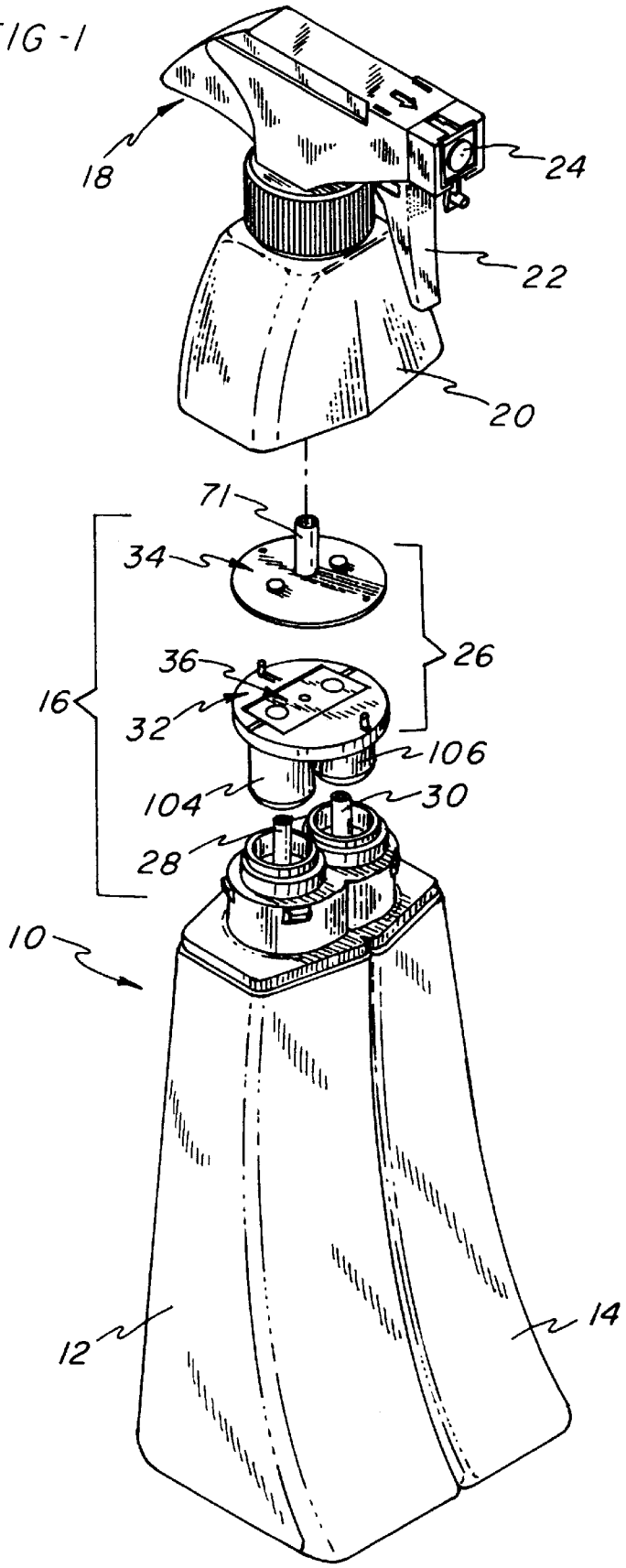
FIG. 1 is an exploded perspective view of a dispensing assembly incorporating the present invention.

Referring to FIG. 1, a fluid dispensing assembly 10 is illustrated including two fluid containers 12, 14 located in side by side relationship, and further including a fluid transfer system 16 and a pump 18. The pump 18 is mounted to a shroud 20 which is adapted for attachment to the containers 12, 14 to thereby enclose the fluid transfer system 16 and maintain the fluid transfer system 16 in engagement with the pump 18. The pump 18 is of a conventional type well known in the art and includes a trigger 22 and a spray nozzle 24 wherein actuating the trigger 22 causes fluid to spray from the nozzle 24 and releasing the trigger 22 causes fluid to be drawn upwardly into the pump 18 from the containers 12, 14. As will be described further below, the fluid transfer system 16 acts to control flow of fluids from the containers 12, 14 whereby substantially equal amounts of the fluids are mixed and provided to the pump 18, while also providing for venting of the containers 12, 14 as the fluids are removed therefrom.

The fluid transfer system 16 includes a dual dispensing valve assembly 26 and dip tubes 28, 30 extending into the containers 12, 14. The valve assembly 26 controls fluid flow out of the containers 12, 14 through the dip tubes 28, 30 while also substantially preventing back flow of fluids from the pump 18 into the containers 12, 14, as well as preventing transfer or crossover of fluids from one container to the other. In addition, it should be noted that the dip tubes 28, 30 are preferably matched to each other such that they have the same inner diameter, in that any small variation in diameter between the tubes 28, 30 may adversely affect the balanced flow of fluids through the dip tubes 28, 30.

Figure 2:
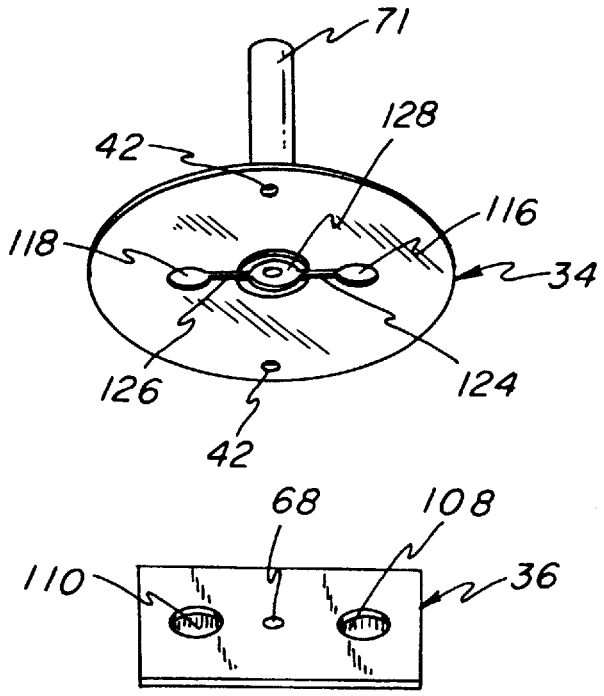
FIG. 2 is an exploded perspective view showing the dual dispensing valve assembly of the present invention.
Figure 2:
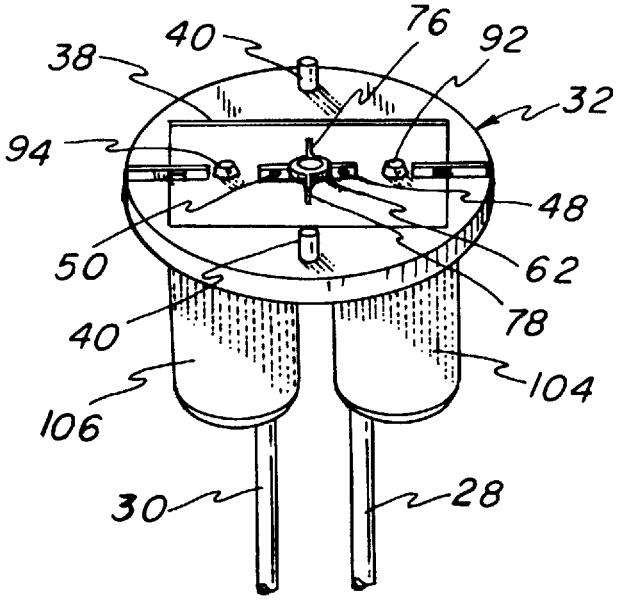

Referring to FIG. 2, the valve assembly 26 includes a base portion 32, a cap portion 34 located above and attached to the base portion 32, and a resilient regulator member 36 positioned between the base portion 32 and the portion 34. The base portion 32 and cap portion 34 are preferably formed of a plastic material such as polypropylene. The regulator member 36 is a flat, relatively thin member and is preferably formed of an elastomeric material such as silicone, and in the preferred embodiment is formed of 30 durometer silicone. The base portion 32 includes a recess 38 conforming to the shape of the outer perimeter of the regulator member 36 for receiving and positioning the regulator member on the base portion 32. In addition, the base portion includes a pair of studs 40 for engagement in holes 42 formed in the cap portion 34 to facilitate alignment of the cap portion 34 to the base portion 32 during assembly. The studs 40 may be heat staked at end portions 41 (see FIG. 4) to thereby maintain the assembly 26 in its assembled condition. Alternatively, the cap portion 34 and base portion 32 may be fastened together by ultrasonic welding or by a snap fit, or by other comparable means for attachment.

Figure 3:
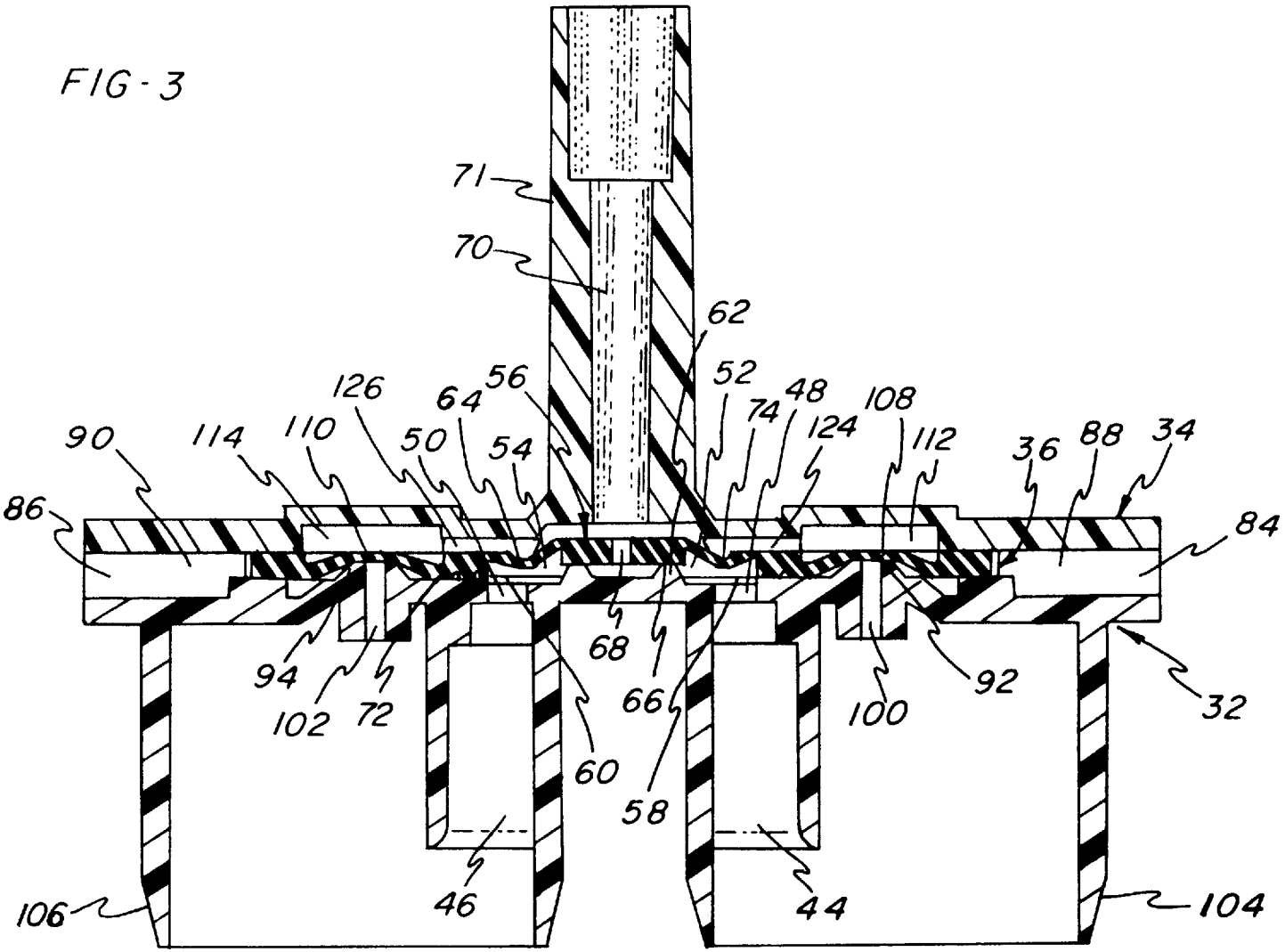
FIG. 3 is a cross-sectional elevational view through the dual dispensing valve assembly.
Figure 5:
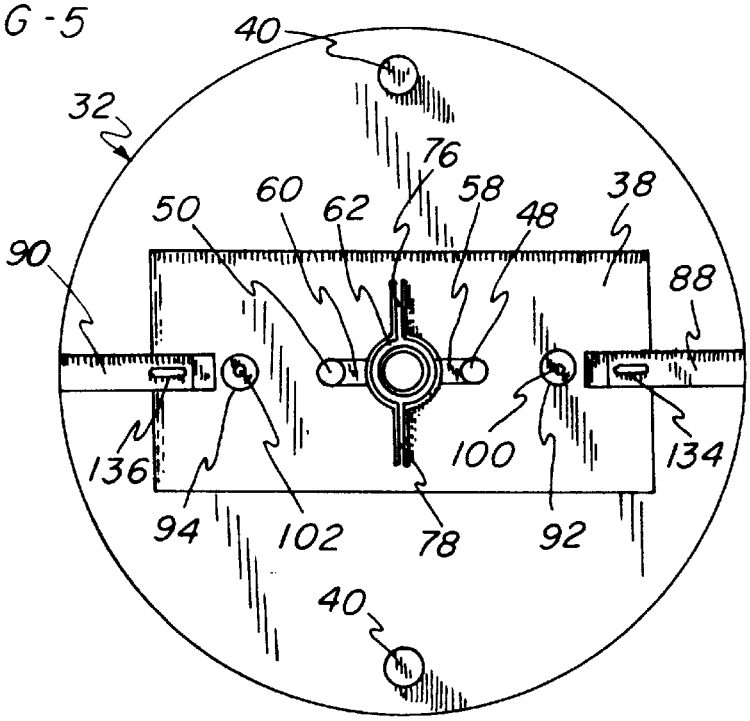
FIG. 5 is a top plan view of a base portion of the dual dispensing valve assembly.

Referring to FIGS. 3 and 5, the dual valve assembly is illustrated in cross-section wherein the base portion 32 and cap portion 34 are joined together to define a housing enclosing the regulator 36. A fluid inlet structure is defined in the base portion 32 and includes dip tube receptor portions 44, 46 for receiving respective dip tubes 28, 30. The receptor portions 44, 46 are in fluid communication with fluid inlet openings 48, 50 which open into fluid passages 52, 54. The fluid passages 52, 54 are defined between a diaphragm portion 56 of the regulator member 36 and an upper surface of the base portion 32. The fluid passages 52, 54 are formed in part by recessed passages 58, 60 defined in the base portion 32 and extending from respective openings 48, 50 toward a diaphragm seat 62 located centrally on the base portion 32.

As may be seen in FIGS. 3 and 7–9, the diaphragm portion 56 includes a thin rectangular membrane portion 64 surrounding a thick central web portion 66. The thick central portion 66 is positioned to contact the diaphragm seat 62 to thereby form a circular fluid seal between the regulator member 36 and the base portion 32. In addition, the thick web portion 66 of the diaphragm portion 56 includes an orifice 68 extending between upper and lower surfaces of the diaphragm portion 56 whereby fluid may pass from the lower side of the diaphragm portion 56 upwardly to an outlet 70 defined by a tube 71 in the cap portion 34. The tube 71 is adapted to engage a tube (not shown) of the pump 18 for supplying fluid to the pump 18.

Figure 8:
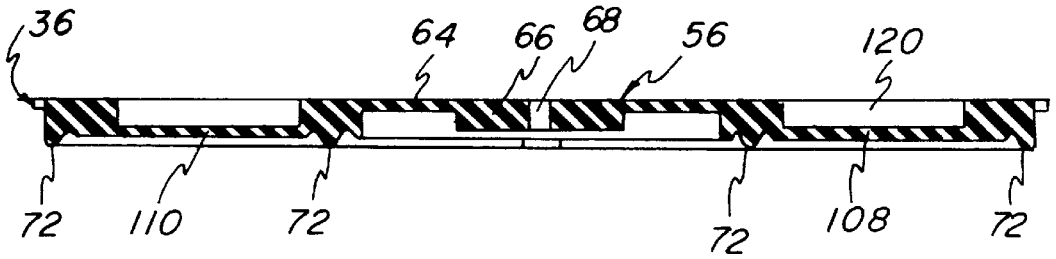
FIG. 8 is a cross-sectional view taken along line 8—8 in FIG. 7.
Figure 9:
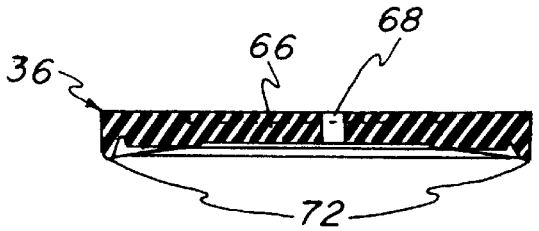
FIG. 9 is a cross-sectional view taken along line 9—9 in FIG. 7.

Thus, as fluid is conveyed into the housing through the fluid inlet structure, it is conveyed toward the orifice 68 by the fluid passages 52, 54 and then passes out of the housing through the outlet 70. The passage of the fluid through the orifice 68 induces a differential pressure which lifts the diaphragm portion 56 out of engagement with the diaphragm seat 62. The membrane portion 64 is a relatively very thin element compared to the thickness of the regulator member 36, as seen in FIGS. 8 and 9, such that the membrane portion 64 will provide a maximum amount of flexibility for permitting movement of the diaphragm 56 away from the seat 62.

It should be noted that the thin membrane portion 64 of the diaphragm 56 forms cavities between the diaphragm portion 56 and the base portion 32 further defining the fluid passages for conveying fluid from the openings 48, 50 to the orifice 68. In addition, a seal 72 is provided on the lower surface of the regulator member 36 for ensuring fluid sealing engagement between the lower surface of the regulator member 36 and the surface of the base portion 32. Similarly, a seal is formed between an upper surface of the regulator member 36 and a lower surface of the cap portion 34 wherein the seal may be in the form of cooperating smooth surfaces, ribs or beads. It should also be noted that the cap portion 34 is provided with a circular pressure rib 74 for bearing down on the thin membrane 64 to thereby bias the diaphragm portion 56 into engagement on the diaphragm seat 62 with a predetermined pressure.

Figure 4:
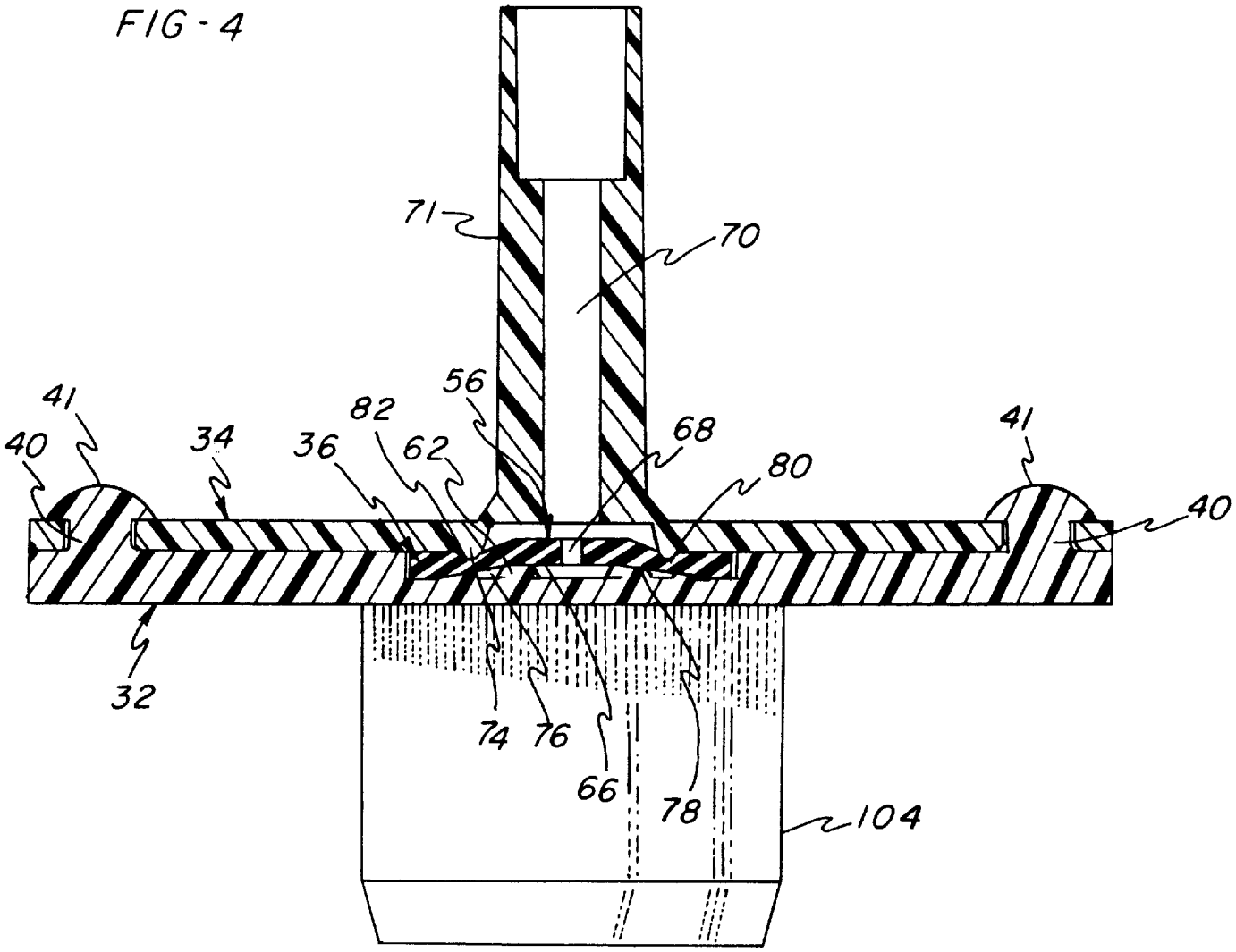
FIG. 4 is a cross-sectional elevational view of the dual dispensing valve assembly taken at right angles to the cross-sectional view of FIG. 3.
Figure 7:
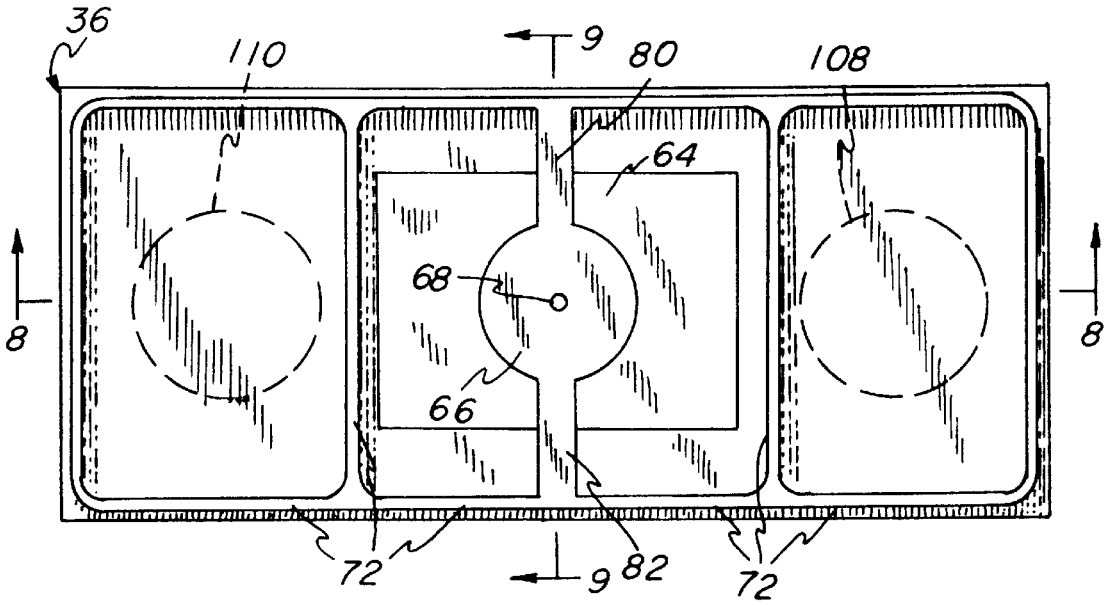
FIG. 7 is a bottom plan view of a regulator member for the dual dispensing valve assembly.

Referring to FIGS. 4, 5 and 7, it can be seen that the base portion 32 is further provided with a pair of partition ribs 76, 78 extending diametrically from the diaphragm seat 62. In addition, the thick central web portion 66 of the diaphragm portion 56 includes a pair of diametrically extending partitioning members 80, 82 which engage with the ribs 76, 78 to thereby partition the fluid passage 52 from the fluid passage 54. In this manner, transfer or cross-over of fluids between the two openings 48, 50 is substantially prevented in that the two fluid passages 52, 54 are sealed from each other when the diaphragm portion 56 is positioned in sealing contact with the diaphragm seat 62. For example, cross-over of fluid from one container 12, 14 to the other container 12, 14 will be prevented in the event that one of the containers 12, 14 has a higher pressure than the other, such as might occur during storage or shipping.

Figure 6:
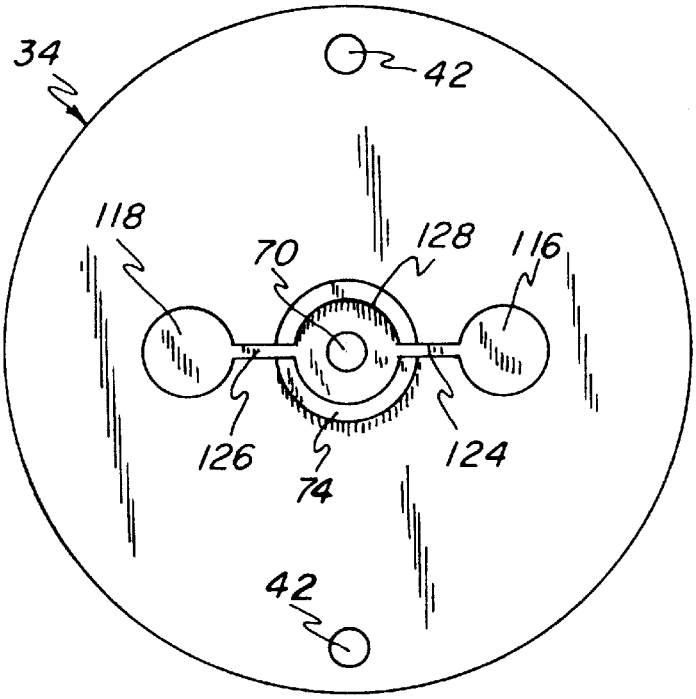
FIG. 6 is a bottom plan view of a cap portion for the dual dispensing valve assembly.

Referring to FIGS. 3 and 6, the valve assembly 26 further includes an air inlet structure comprising openings 84, 86 located on opposing sides of the housing defined by the cap portion 34 and base portion 32 wherein air may pass through the openings 84, 86 into air passages 88, 90 defined by grooves in the base portion 32.

An air vent seat structure is defined in the base portion 32 and includes conical seats 92, 94 extending above the base portion 32. The conical seats 92, 94 define vent seat openings 100, 102 for allowing air to pass from the housing into respective containers 12, 14. It should be noted that the base portion includes a pair of inner shroud members 104, 106 which are adapted to be inserted in a tight fit within neck portions of the containers 12, 14, and that the vent seat openings 100, 102 open into the shrouds 104, 106.

The regulator member 36 includes a vent valve structure comprising circular vent membrane portions 108, 110 which have a thickness substantially less than the thickness of the regulator member 36 (see FIG. 8) and which are positioned to extend over upwardly extending portions of the conical seats 92, 94. Thus, the vent membranes 108, 110 are preloaded over the openings 100, 102 to close the air passages 88, 90 and prevent flow of fluids out of the containers 12, 14 through the vent seat openings 100, 102.

Referring to FIGS. 3, 6 and 8, vent chambers 112, 114 are defined over the vent membranes 108, 110 and are formed by recesses 116, 118 in the cap portion 34 positioned over respective recesses 120, 122 in the regulator member 36 at the locations of the vent membranes 108, 110. Grooves 124, 126 in the cap portion 34 extend from the recesses 116, 118, through the circular pressure rib 74, to a central recess area 128 at the outlet 70 in the cap portion 34 to thereby place the vent chambers 112, 114 in fluid communication with the outlet 70. When a negative pressure is applied through the outlet 70, such as by actuation of the pump 18, negative pressure areas will be created in the vent chambers 112, 114 to thereby lift the vent membranes 108, 110 out of contact with respective conical seats 92, 94 to thereby open the vents and allow passage of air into the containers 12, 14.

It should be noted that the above mentioned seal 72 between the lower surface of the regulator member 36 and the upper surface of the base portion 32 extends around the vent membranes 108, 110 to prevent air from passing into contact with the fluid passages 52, 54, as well as to prevent fluid from leaking out. In addition, in order to ensure that the outer edges regulator member 36 adjacent to the air inlets 84, 86 do not extend downwardly into the air passages 88, 90, support ridges 134, 136 are provided centrally located within the passages 88, 90 to support the regulator member 36 along the seal 72. Also, the support ridges 134, 136 ensure that a peripheral outer seal portion of the upper surface of the regulator member 36 is maintained in sealing contact with the cap portion 34 in the area of the air passages 88, 90 to thereby prevent air from leaking into the housing above the regulator member 36, which could prevent proper pumping action.

In operation, the pump 18 is actuated by means of the trigger 22 thereby creating a negative pressure or a vacuum within the outlet 70. In response to the negative pressure in the outlet 70, the diaphragm portion 56 of the regulator member 36 is drawn upwardly off of the diaphragm seat 62, and simultaneously, the vent membranes 108, 110 are drawn upwardly away from the conical seats 92, 94. Thus, at the same time that the fluid inlet structure is opened for supplying fluid to the outlet 70, the air vent structure for supplying vent air to the containers 12, 14 is opened. This is particularly critical during pumping of fluid from the containers 12, 14 in that even a small delay in opening one or the other of the vent seat openings 100, 102 may result in an unequal distribution of fluids from the two containers 12, 14, and result in the contents of one of the containers being used up before the contents of the other container. In addition to ensuring that proper venting is provided to both of the containers, the vent membranes 108, 110 further ensure that a fluid tight seal is provided over each of the vent seat openings 100, 102 at all times when the pump 18 is not being actuated, and thereby prevent fluids from leaking out through the vent inlets 84, 86.

It should be noted that the orifice 68 in the center of the diaphragm portion 56 is sufficiently small to ensure that a substantial pressure differential is developed between the upper and lower surfaces of the diaphragm portion 56 for lifting the diaphragm portion 56 out of engagement with the diaphragm seat 62. Further, the membrane portions 64, 108, 110 of the regulator member are formed as thin elements resulting in the diaphragm portion 56 and vent membranes 108, 110 being responsive to relatively low negative pressures (20 in. Hg) applied during actuation of the pump 18 such that the fluid and vent openings are readily opened.

It should also be noted that although each pair of fluid inlet openings 48, 50 and vent openings 96, 98 are shown located on opposing sides of the diaphragm seat 62, these openings may be located at other locations while incorporating the principles of the present invention. For example, it may be desirable to provide different locations for the openings in order to accommodate different container configurations.

In addition, it should be noted that the regulator member 36 is formed as a relatively thin flat member having a substantially rectangular shape. The rectangular shape facilitates handling of the regulator member, and particularly facilitates handling of the regulator member by automated machinery. Further, while in this embodiment the regulator member 36 is shown as a rectangular member, it should be understood that this member 36 may be formed as a square or other shape, depending upon the particular packaging in which the regulator member 36 is used. For example, different container configurations may incorporate regulator members 36 having different shapes to accommodate the particular container configurations. Also, the regulator member 36 may be reconfigured to include only one vent diaphragm for providing vent air to both sides of the packages, and the package may also be modified wherein a single bottle is provided having a partition to form two separate fluid containers within the bottle.

It should further be understood that the present invention may be constructed to accommodate fluid dispensing from a different number of containers than that shown herein. For example, the valve assembly may be provided with additional fluid passages and vent structures to dispense fluids from three or more containers at regulated rates.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A valve assembly for controlling flow of fluid from a plurality of fluid supplies, said valve assembly comprising:

a housing including a base portion and a cap portion;

an outlet defined in said cap portion for conveying fluid from said housing;

a plurality of fluid supply inlets defined in said base portion for supplying fluid to said housing;

a regulator formed of a resilient material and located between said base portion and said cap portion;

a diaphragm defined on said regulator, said diaphragm having an upper surface and a lower surface;

an orifice defined through said diaphragm extending between said upper surface and said lower surface and in fluid communication with said outlet;

fluid passages defined between said regulator and said base portion and located between said supply inlets and said orifice;

a diaphragm seat defined on said base portion for engagement with said diaphragm whereby a fluid seal is defined between said supply inlets and said orifice; and wherein said diaphragm is normally seated in engagement with said diaphragm seat, and said diaphragm is movable out of engagement with said diaphragm seat in response to a negative pressure applied to said upper surface of said diaphragm whereby fluid entering said supply inlets will flow through said orifice and out of said housing through said outlet.

2. The assembly of claim 1 including means for preventing fluid flow between said supply inlets when said diaphragm is seated in engagement with said diaphragm seat.

3. The assembly of claim 1 including a plurality of vent openings defined through said base portion, and vent conduits for conveying air from outside said housing to said vent openings, said regulator including vent valves formed integrally with said regulator to close said vent openings to prevent fluid flow through said vent openings wherein said vent valves are movable to open said vent openings.

4. The assembly of claim 3 wherein said vent valves include an upper surface in fluid communication with said outlet and said vent valves are movable away from said vent openings in response to a negative pressure applied from said outlet.

5. The assembly of claim 3 wherein said vent openings each include a vent seat extending toward said regulator from said base portion and said vent valves comprise membranes positioned in contact with said vent seats.

6. The assembly of claim 1 wherein said regulator is formed of an elastomeric material.

7. The assembly of claim 1 wherein said outlet defines a diameter sufficiently small to produce a pressure differential across said diaphragm for moving said diaphragm out of engagement with said seat.

8. The assembly of claim 1 including a manually operable pump coupled to said outlet for drawing fluid through said housing.

9. A valve assembly comprising:

a housing including a base portion and a cap portion;

an outlet defined in said cap for conveying fluid from said housing;

fluid supply means comprising at least one fluid supply inlet defined in said base portion for supplying fluid to said housing;

a regulator formed of a resilient material and located between said base portion and said cap portion;

a diaphragm defined on said regulator, said diaphragm having an upper surface and a lower surface;

an orifice defined through said diaphragm extending between said upper surface and said lower surface and in fluid communication with said outlet;

at least one fluid passage defined between said regulator and said base portion and located between said at least one supply inlet and said orifice;

a diaphragm seat defined on said base portion for engagement with said diaphragm whereby a fluid seal is defined between said at least one supply inlet and said orifice;

vent means including at least one vent opening defined through said base portion, and at least one vent conduit for conveying air from outside said housing to said at least one vent opening;

vent valve means including at least one vent valve for opening and closing said at least one vent opening; and wherein said diaphragm is normally seated in engagement with said diaphragm seat and said at least one vent valve is normally positioned to close said at least one vent opening, and said diaphragm is movable out of engagement with said diaphragm seat and said at least one vent valve is movable to open said at least one vent opening in response to a negative pressure applied from said outlet.

10. The assembly of claim 9 wherein said at least one vent valve comprises a membrane formed integrally with said regulator and positioned over said at least one vent opening.

11. The assembly of claim 9 wherein said fluid supply means comprises first and second supply inlets and tubes connected to each of said first and second supply inlets for extending into two different containers of fluid and supplying different fluids to said housing.

12. The assembly of claim 11 wherein said vent means comprises first and second vent openings defined in said base portion adjacent to said first and second supply inlets, respectively, for venting air to containers supplying fluid to said fluid supply means.

13. The assembly of claim 12 wherein said vent valve means comprises first and second membranes formed integrally with said regulator and defining first and second vent valves positioned over said first and second vent openings wherein said first and second membranes are movable away from said vent openings in response to negative pressure applied through said outlet.

14. The assembly of claim 9 wherein said regulator comprises a thin, flat elastomeric member having a predetermined thickness, and said vent valve means comprises an area of reduced thickness on said regulator for engaging said base portion at said at least one vent opening.

15. A valve assembly comprising:

a housing including a base portion and a cap portion engaged on said base portion;

an outlet defined in said cap for conveying fluid from said housing;

a fluid inlet structure defined in said base portion for conveying fluid into said housing, and a fluid passage defined between said fluid inlet structure and said outlet;

an air inlet structure for conveying air into said housing;

a vent seat structure for conveying air out of said housing, and an air passage between said air inlet structure and said vent seat structure; and a regulator formed of a resilient material and located between said base portion and said cap portion, said regulator including a diaphragm portion for opening and closing said fluid passage, and said regulator further including a vent valve structure for opening and closing said air passage.

16. The assembly of claim 15 wherein said air passage extends from a side of said housing between said regulator and said base portion.

17. The assembly of claim 16 wherein said air passage is defined by a groove in said base portion.

18. The assembly of claim 15 wherein said regulator comprises a thin, flat elastomeric member and said vent valve structure is defined by an area of reduced thickness, said area of reduced thickness having an upper surface facing said cap portion and a lower surface facing said vent seat structure.

19. The assembly of claim 18 wherein said upper surface of said area of reduced thickness is in fluid communication with said outlet.

20. The assembly of claim 15 wherein said base portion includes a diaphragm seat and said diaphragm portion moves into and out of engagement with said diaphragm seat to open and close said fluid passage.

21. The assembly of claim 15 wherein said diaphragm includes an orifice for permitting passage of fluid flowing from said fluid inlet structure to said outlet.

22. The assembly of claim 21 wherein said orifice defines a fluid flow area which is of a sufficiently small size such that a negative pressure applied at said outlet will draw said diaphragm portion toward said outlet while causing fluid flow through said orifice.

23. The assembly of claim 15 wherein said fluid inlet structure includes two fluid paths for supplying two fluids in equal amounts to said housing.

* * * * *